US006883948B2

(12) United States Patent
VanDuyn et al.

(10) Patent No.: US 6,883,948 B2
(45) Date of Patent: Apr. 26, 2005

(54) AUTOMOTIVE LAMP ASSEMBLY MOISTURE CONTROL SYSTEM

(75) Inventors: Paul D. VanDuyn, Anderson, IN (US); Christopher R. Powers, Indianapolis, IN (US)

(73) Assignee: Guide Corporation, Pendleton, IN (US)

( * ) Notice: Subject to any disclaimer, the term of this patent is extended or adjusted under 35 U.S.C. 154(b) by 75 days.

(21) Appl. No.: 10/342,763

(22) Filed: Jan. 15, 2003

(65) Prior Publication Data

US 2003/0133310 A1 Jul. 17, 2003

Related U.S. Application Data

(60) Provisional application No. 60/349,881, filed on Jan. 17, 2002.

(51) Int. Cl.[7] ..... F21V 29/00

(52) U.S. Cl. ..... 362/547; 362/267; 362/294; 362/373

(58) Field of Search ..... 362/546, 547, 362/96, 267, 294, 373

(56) References Cited

U.S. PATENT DOCUMENTS

| | | | | |
|---|---|---|---|---|
| 4,612,607 A | * | 9/1986 | Segoshi et al. | 362/547 |
| 4,739,458 A | | 4/1988 | Yamayoshi et al. | |
| 4,755,917 A | * | 7/1988 | Bals et al. | 362/547 |
| 4,796,163 A | | 1/1989 | Dressler | |
| 4,809,144 A | | 2/1989 | Suzuki | |
| 4,937,710 A | | 6/1990 | Hurley et al. | |
| 5,010,453 A | | 4/1991 | Ketterman | |
| 5,406,467 A | | 4/1995 | Hashemi | |
| 5,416,682 A | | 5/1995 | Bromhall | |
| 5,497,308 A | | 3/1996 | Ohtsuka et al. | |
| 5,536,019 A | | 7/1996 | Bryant et al. | |
| 5,556,193 A | | 9/1996 | Ferrell | |
| 5,611,612 A | | 3/1997 | Choji et al. | |
| 5,758,957 A | | 6/1998 | Perrotin | |
| 5,775,794 A | | 7/1998 | Schmitt | |
| 5,980,074 A | | 11/1999 | Hwang | |
| 6,021,954 A | | 2/2000 | Kalwa et al. | |
| 6,210,014 B1 | | 4/2001 | Kubizne et al. | |
| 6,422,729 B1 | * | 7/2002 | Rohrbach et al. | 362/547 |
| 6,709,493 B1 | * | 3/2004 | DeGuiseppi et al. | 96/7 |

FOREIGN PATENT DOCUMENTS

| | | |
|---|---|---|
| EP | 0 859 188 A2 | 1/1998 |
| JP | 10309977 A | 11/1998 |

* cited by examiner

*Primary Examiner*—Y. My Quach-Lee
*Assistant Examiner*—Peggy Neils
(74) *Attorney, Agent, or Firm*—Ice Miller; Jay G. Taylor

(57) ABSTRACT

The subject invention comprises a headlamp moisture control system that comprises at least one desiccant and at least one valve. The desiccant comprises an interior desiccant surface that forms an intake passageway and an exterior desiccant surface that forms at least one exhaust passageway. Further, the exterior desiccant surface area has a surface area that is greater than the interior desiccant surface area. The at least one valve can comprise an intake valve and an exhaust valve or it can comprise a combination valve. In either embodiment, the at least one valve prevents the desiccant from constantly being exposed to air that contains moisture. The moisture control system prevents moisture from entering a headlamp assembly during the cooling of a headlamp by only allowing air to enter the headlamp assembly through the intake passageway over the interior desiccant surface. To prevent the desiccant from being saturated, the desiccant will be regenerated during the operation of the headlamp assembly by exhausting dry, heated air from the headlamp assembly through the at least one exhaust passageway over the exterior desiccant surface. Thus, the desiccant will be regenerated and ready to absorb moisture from the incoming air once the headlamp assembly is turned off and begins to cool.

29 Claims, 19 Drawing Sheets

AUTOMOTIVE LAMP ASSEMBLY MOISTURE CONTROL SYSTEM

CROSS-REFERENCE TO RELATED APPLICATIONS

This application claims the benefit of U.S. Provisional Application No. 60/349,881, filed Jan. 17, 2002.

BACKGROUND OF THE INVENTION

The subject invention relates generally to automotive lamp assemblies. More specifically, the subject invention relates to devices that prevent moisture from accumulating on the interior surfaces of automotive headlamps.

The accumulation of moisture on the interior of automotive headlamps is caused by several different factors and is a common problem in the automotive headlamp industry. For example, ventilation devices are widely used by prior headlamp assemblies to cool the interior of the headlamp and to equalize the pressure between the exterior and interior of the headlamp during operation. While ventilation devices perform these important functions, some of the prior art devices also have the drawback of allowing liquid water to enter the interior of the headlamp during inclement weather conditions, such as rainstorms. To solve this problem, prior art ventilation systems utilize vent patches, vent tubes, and combinations of both to protect against liquid water from directly entering the headlamp. However, these devices have the drawback of not protecting a headlamp assembly against the introduction of water vapor through the ventilation device during the cooling of the headlamp.

Moisture in the form of water vapor can enter a headlamp when the headlamp is turned off and the interior begins to cool ("intake cycle"). As the interior of the headlamp begins to cool, a negative pressure relative to the exterior of the headlamp is created. As used herein, the term "negative pressure condition" means that the pressure in the interior of the headlamp is less than the pressure on the exterior of the headlamp. In order to equalize the pressure, some form of a venting device is placed on the headlamp to allow air from the atmosphere to enter the interior of the headlamp. The air from the atmosphere contains moisture that condenses on the interior of the headlamp once it enters the headlamp assembly.

The condensation on the interior of the headlamp can cause numerous problems. For example, the moisture that condenses on the interior of the headlamp may cause degradation of the materials comprising the headlamp assembly and lead to the complete failure of the headlamp. Moreover, the condensation can create an undesirable aesthetic appearance, diminish the intensity of the light emitted from the headlamp and alter the direction of the light emitted from the headlamp. Thus, the condensation can cause the light emitted from the headlamp to fall outside of the governmental regulations for headlamps.

One attempt to prevent water vapor from entering the headlamp and condensing on the interior of the headlamps is the use of venting devices which contain a desiccant or a drying agent. However, a desiccant or drying agent alone becomes ineffective at removing the moisture from the air once it becomes saturated with absorbed moisture. Saturation is a common problem with desiccants and drying agents used in ventilation systems due to two factors. First, prior art assemblies do not seal off the desiccant or drying agent from the outside air at any point in time. Thus, the desiccant or drying agent is always exposed to outside air and continually absorbs water from the air during humid conditions.

Second, prior art systems do not allow the desiccant or drying agent to adequately "regenerate." As used herein, the term "regenerate" means to remove an adequate portion of previously-absorbed moisture from the desiccant or drying agent during the exhaust cycle, thereby conditioning it for the subsequent absorption of additional water vapor (i.e. moisture) during the next intake cycle. The exhaust cycle refers to the period of time that a headlamp assembly is being operated and begins to exhaust heated air from the interior of the headlamp assembly. During the exhaust cycle, the hot exhausting air dries the desiccant or drying agent and allows the desiccant or drying agent to continue to absorb water during further intake cycles and during the period of equilibrium when the headlamp assembly is not in its intake cycle or exhaust cycle. A disadvantage with prior art ventilation devices is that the volume of the exhaust and intake air is not regulated to optimize the process of moisture absorption and removal.

While the prior art does offer some methods of regeneration, none provide for total or even adequate regeneration of the desiccant or drying agent. Due to this problem, the desiccant or drying agent is often in a saturated state and cannot adequately remove water from air that enters into the headlamp. Thus, the introduction of moisture to the interior of a headlamp is still a problem that plagues the art. Accordingly, it is desired to provide a, system that results in a continually condensation free headlamp interior.

BRIEF SUMMARY OF THE INVENTION

The subject invention comprises a headlamp moisture control system that comprises at least one desiccant and at least one valve. The desiccant comprises an interior desiccant surface that forms an intake passageway and an exterior desiccant surface that defines at least one exhaust passageway. Further, the exterior desiccant surface has a greater surface area than the interior desiccant surface area in order to allow for quicker regeneration.

The at least one valve prevents the desiccant from constantly being exposed to air that contains moisture by only allowing air to enter the moisture control system during the cooling of a headlamp assembly and to exit during the operation of the headlamp assembly. The moisture control system can further comprise a lid containing at least one air intake port, at least one air intake channel adjacent to the air intake port, and a filter that prevents dust and water from entering the at least one air intake port. Moreover, the subject invention can comprise a ventilation hole aligned with the intake passageway and exhaust channels aligned with the at least one exhaust passageway.

The moisture control system prevents moisture from entering a headlamp assembly by exposing entering air to the interior desiccant surface. After the operation of the headlamp assembly, the headlamp will begin to cool. As the interior of headlamp assembly cools, it creates a negative pressure relative to the exterior of the headlamp. The higher external pressure causes the at least one valve to open causing air to pass through the intake passageway, exposing the air to the interior desiccant surface. The moisture from the air will be absorbed by the desiccant and the air will pass through the ventilation hole into the headlamp assembly.

To prevent the desiccant from being saturated, the desiccant will be regenerated during the operation of the headlamp assembly. During operation of the headlamp assembly, a light source is energized and generates heat. The resulting heat builds up in the interior of the headlamp assembly and creates a positive pressure inside the headlamp relative to the exterior of the headlamp. As used herein, the term "positive pressure condition" means that the pressure in the interior of the headlamp assembly is greater than the pressure on the exterior of the headlamp assembly. The higher internal pressure causes the at least one valve to open causing the dry heated air to pass through the at least one exhaust passageway. As air passes through the at least one exhaust passageway, it is exposed to the air to the exterior desiccant surface. The dry, heated air will remove the moisture from the desiccant and the air and moisture will be exhausted out of the moisture control system. Thus, the desiccant will be regenerated and ready to absorb moisture from the incoming air once the headlamp assembly is turned off and begins to cool.

DESCRIPTION OF THE INVENTION

The subject invention comprises a headlamp moisture control system that combines a desiccant and a ventilation device, wherein the moisture control system regenerates the desiccant and prevents the continual absorption of moisture by the desiccant from the outside air. By regenerating the desiccant, the moisture control system ensures that the desiccant can continually absorb moisture from the air entering into the headlamp interior and provide a condensation free headlamp interior.

Figure 1:
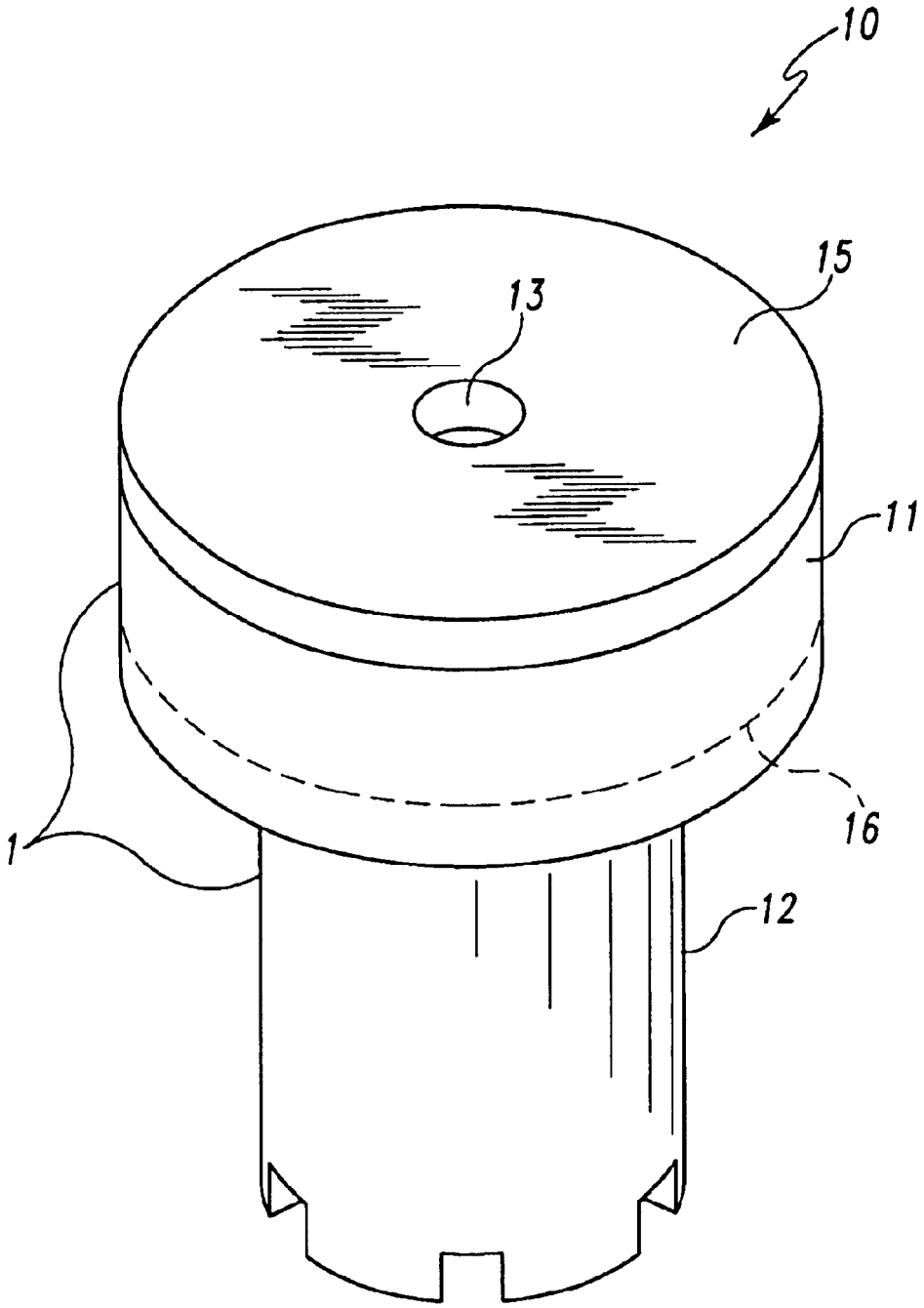
FIG. 1 is a side perspective view of an exemplary embodiment of the headlamp moisture control system of the subject invention without a filter.

Referring specifically to FIG. 1, there is shown a perspective side view of an exemplary embodiment of the subject invention. Moisture control system 10 comprises a housing 1 and a lid 15 with an air intake port 13. As shown in FIG. 1, housing 1 comprises generally of a valve housing 11 and a desiccant housing 12. Valve housing 11 and desiccant housing 12 are two pieces in this embodiment and are attached and sealed together along top 16 of desiccant housing 12 by any of a number of ways known by one skilled in the art. Suitable methods of attaching valve housing 11 to desiccant housing 12 include, but are not limited to, sonic welding or the use of an adhesive.

Further, air intake port 13 is located in the center of lid 15 and allows air to pass into moisture control system 10. While the exemplary embodiment in FIG. 1 shows the subject invention with one air intake port 13, it is appreciated by one skilled in the art that a single air intake port or any number of a plurality of air intake ports can be used in the subject invention. Further, it is appreciated by one skilled in the art that air intake port 13 can be located in different positions other than the center of lid 15.

Figure 2:
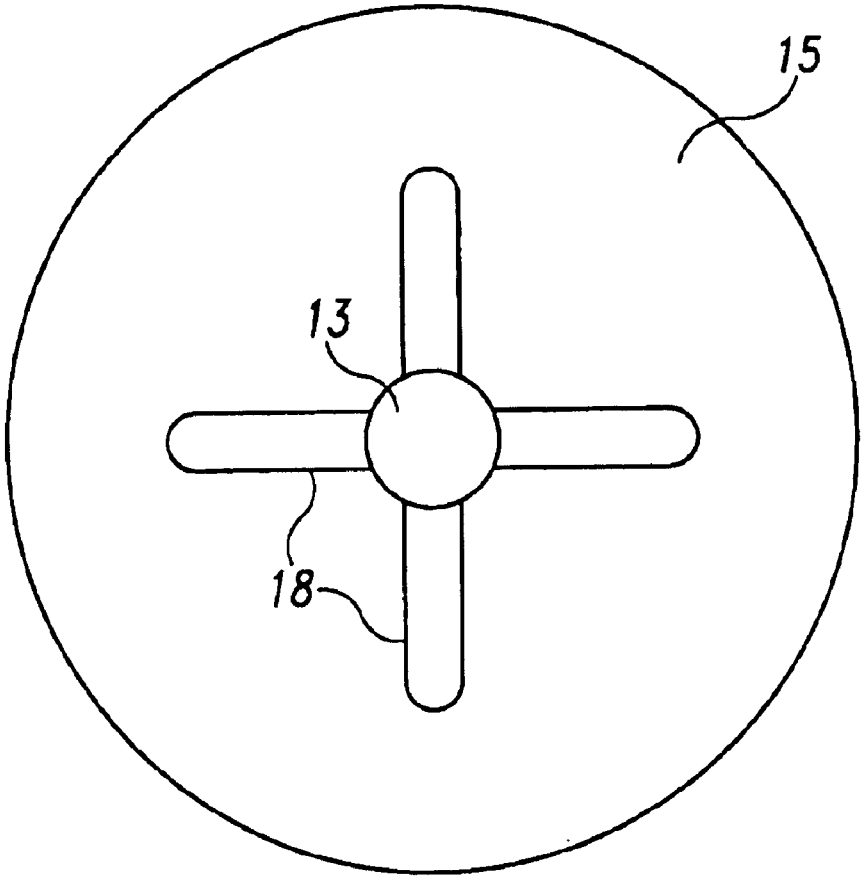
FIG. 2 is a bottom view of a lid used in the moisture control system of FIG. 1.

FIG. 2 shows a bottom view of lid 15. As shown in FIG. 2, a plurality of intake channels 18 are located adjacent to air intake port 13. Intake channels 18 allow air to pass in between an intake valve 23 (shown in FIG. 7*b*) and lid 15. Intake channels 18 help guide incoming air toward a seal edge 25 of intake valve 23. While the exemplary embodiment displayed in FIG. 2 shows four intake channels 18, it will be appreciated by one skilled in the art that any number of intake channels or no air intake channels can be utilized in the subject invention. Lid 15 is sealed to valve housing 11 by any of a number of ways known by one skilled in the art. Suitable methods of sealing lid 15 to valve housing 11 include, but are not limited to, sonic welding or the use of an adhesive.

Figure 3:
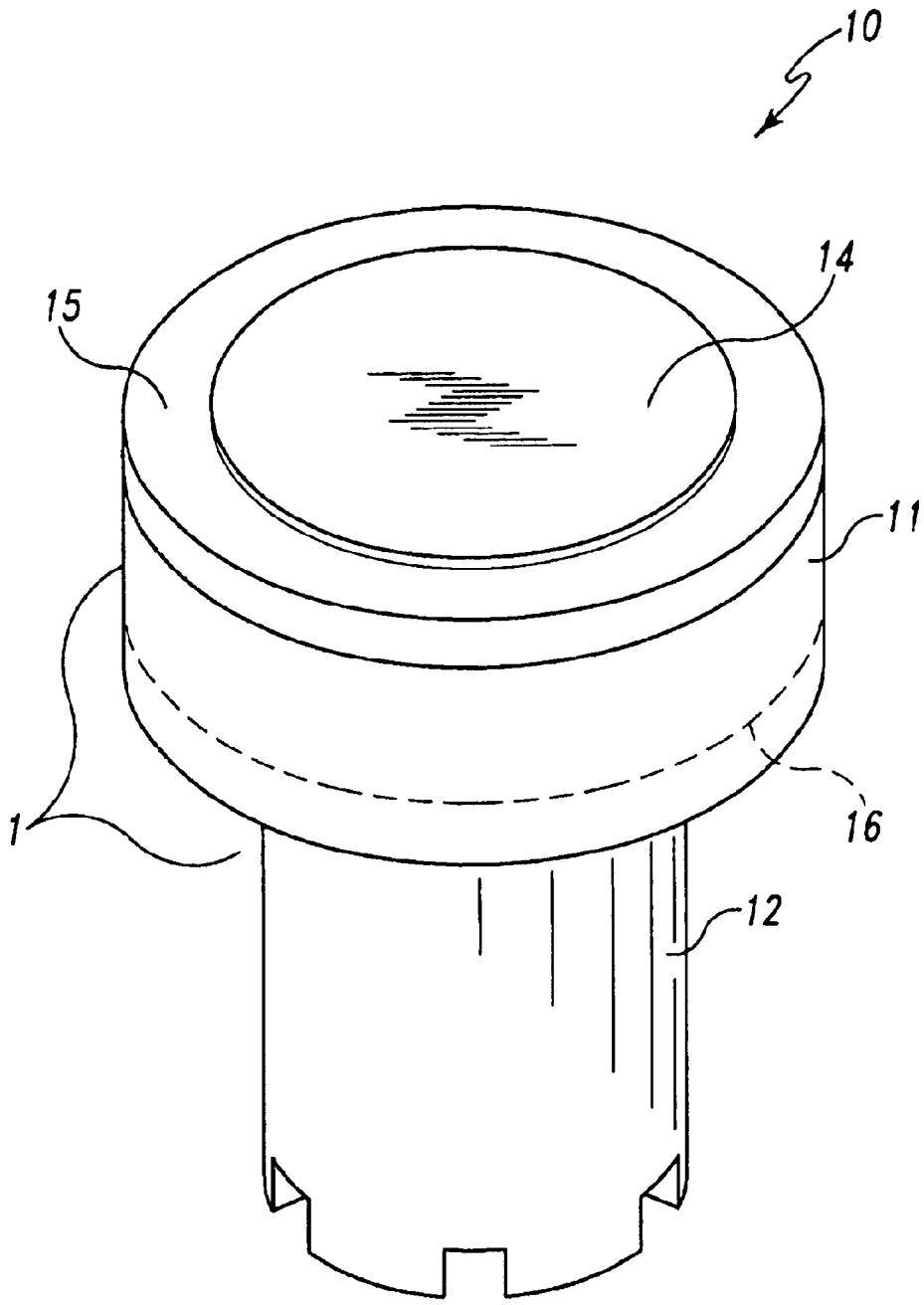
FIG. 3 is a side perspective view of the moisture control system of FIG. 1 with the filter in place.

As shown in FIG. 3, moisture control system 10 further comprises a filter 14. Filter 14 covers air intake port 13 and acts to prevent the intrusion of water and particulate matter into a headlamp assembly through moisture control system 10. While this exemplary embodiment uses a thin air permeable film as filter 14, it will be appreciated by one skilled in the art that other devices or membranes, such as a molded porous insert, can be used to similarly prevent water and particulate matter from entering the headlamp moisture control system.

Figure 4:
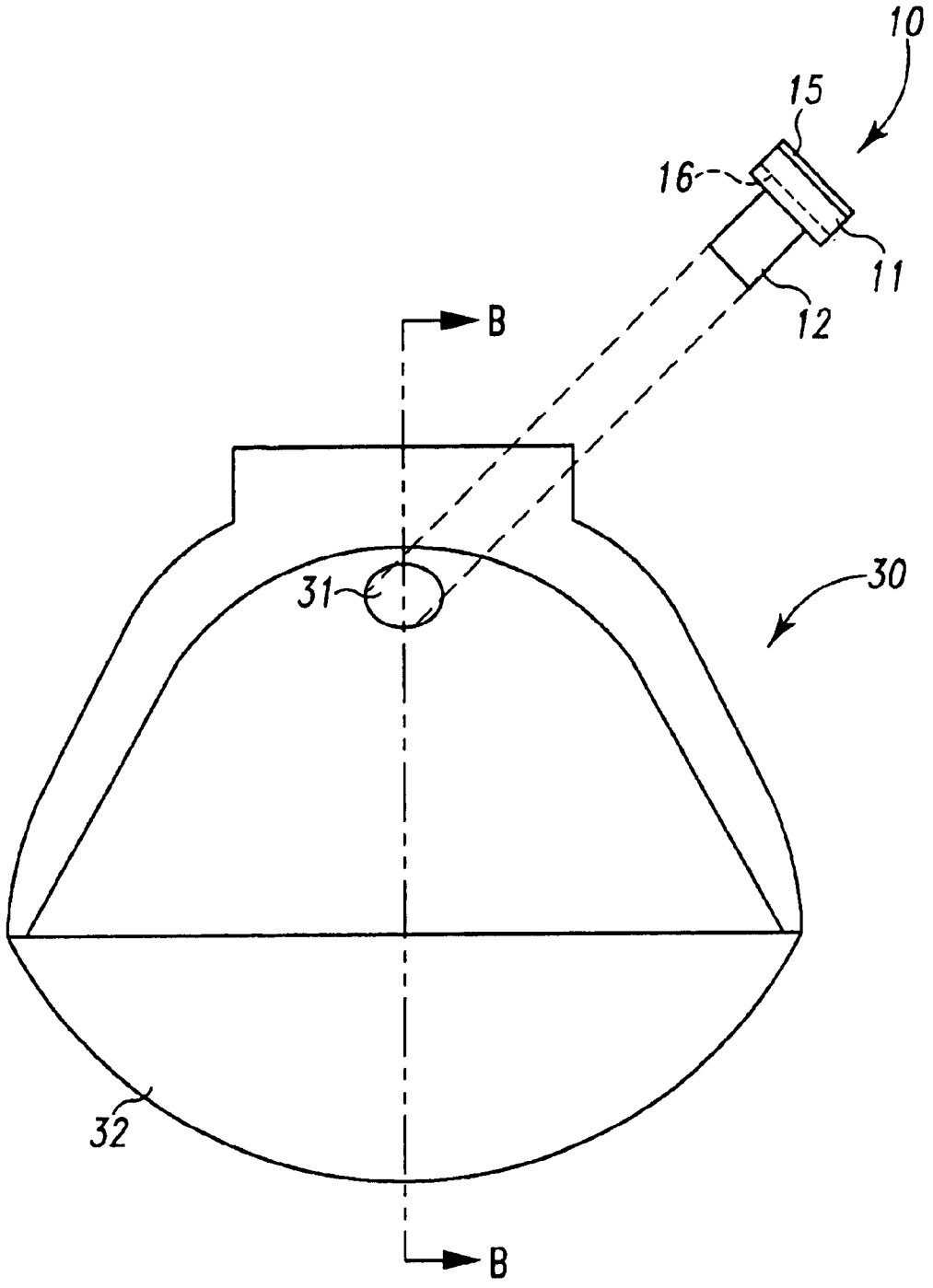
FIG. 4 is an exploded top view of an exemplary headlamp assembly showing placement of the moisture control system of FIG. 3 in the headlamp assembly.

FIG. 4 shows an exploded top view of a headlamp assembly 30 that can accept the subject invention. As shown in FIG. 4, moisture control system 10 is inserted into a vent hole 31 located on headlamp assembly 30, so that desiccant housing 12 is inserted into the vent hole. One skilled in the art realizes that moisture control system 10 does not have to be inserted into a vent hole but can be attached to headlamp assembly 30 in any number of ways so that air will enter and exit the headlamp assembly 30 through the moisture control system.

Figure 5:
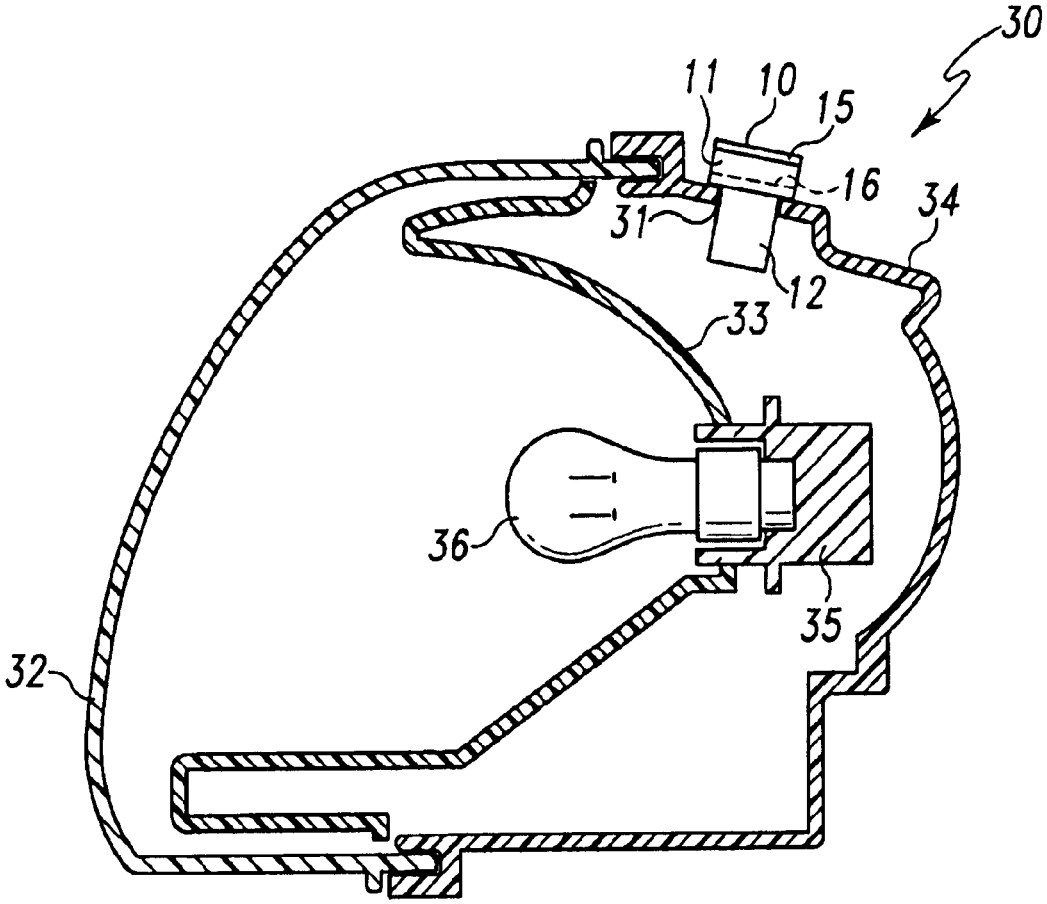
FIG. 5 is a side, cross-sectional view of the headlamp assembly along line B—B of FIG. 4.

FIG. 5 shows a cross sectional view of headlamp assembly 30 along line B—B of FIG. 4. As shown in FIG. 5, headlamp assembly 30 comprises moisture control system 10, a lens 32, a reflector 33, an exterior lamp housing 34, a rear-loaded socket assembly 35 and a bulb 36. Moisture control system 10 is located on the top of headlamp assembly 30 in vent hole 31 on exterior lamp housing 34. Location of moisture control system 10 at the top of headlamp assembly 30 allows the moisture control system to take advantage of the heat built up in headlamp assembly 10 by bulb 36. While the exemplary embodiment of headlamp assembly 30 shows moisture control system 10 located in this position, one skilled in the art realizes that the subject invention can be placed at any location in the headlamp assembly. Further, while FIG. 5 shows the moisture control system utilized in a headlamp assembly of a particular construction, one skilled in the art realizes that the moisture control system can be utilized with any type of an automotive lamp assembly.

Figure 6:
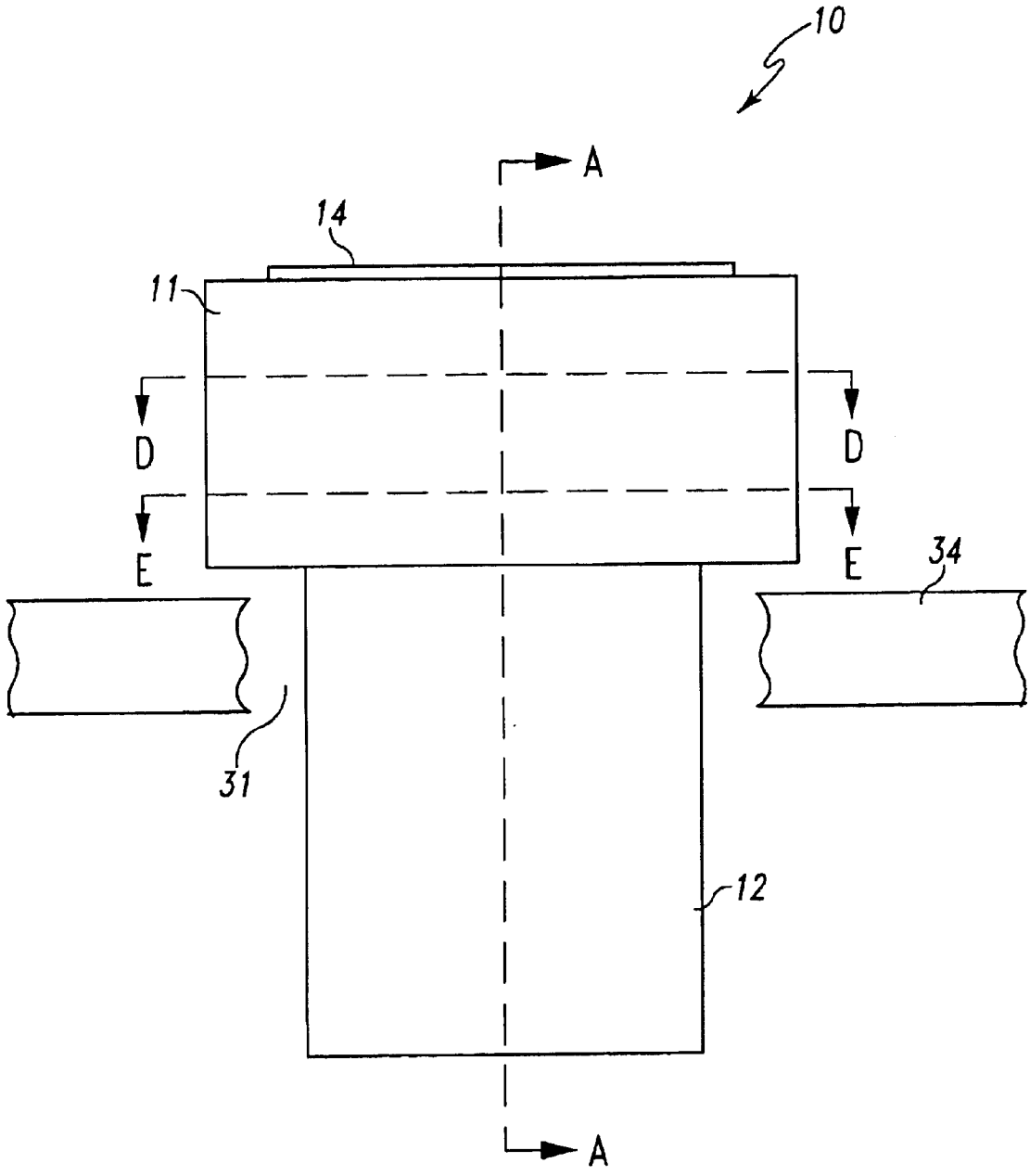
FIG. 6 is a side view of the moisture control system of FIG. 3 installed in a headlamp assembly.

FIG. 6 shows a side view of moisture control system 10 in relation to lamp housing 34, once the moisture control system is inserted into vent hole 31. In this position, air will be able to pass through moisture control system 10 and into and out of the interior of headlamp assembly 30. Moisture control system 10 may be attached to headlamp assembly 30 by various attachment means known to those of ordinary skill in the art and such attachment means should not limit the scope of the subject invention.

Figure 7A:
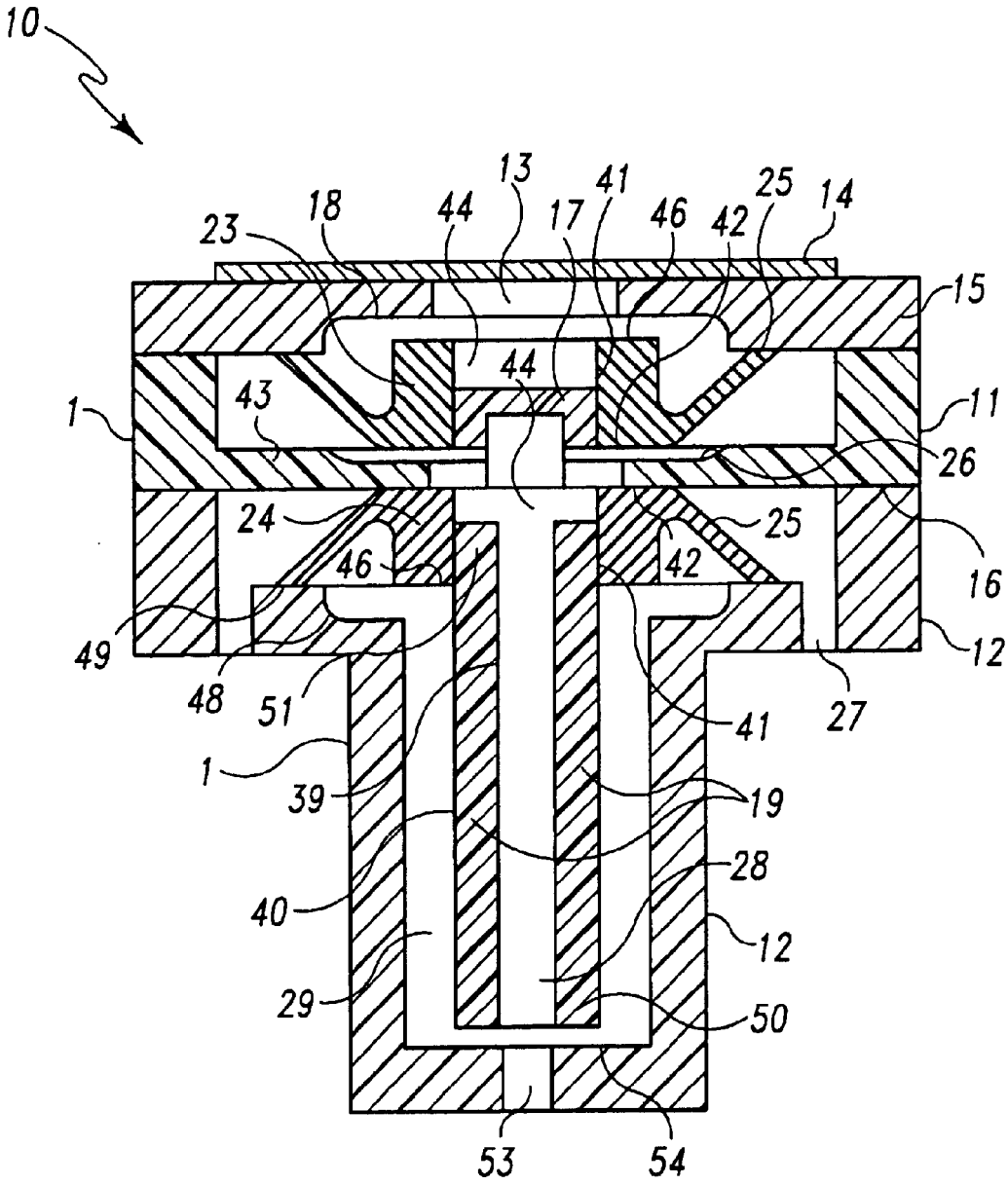
FIG. 7*a* is a cross-sectional view of the moisture control system along line A—A of FIG. 6.
Figure 7B:
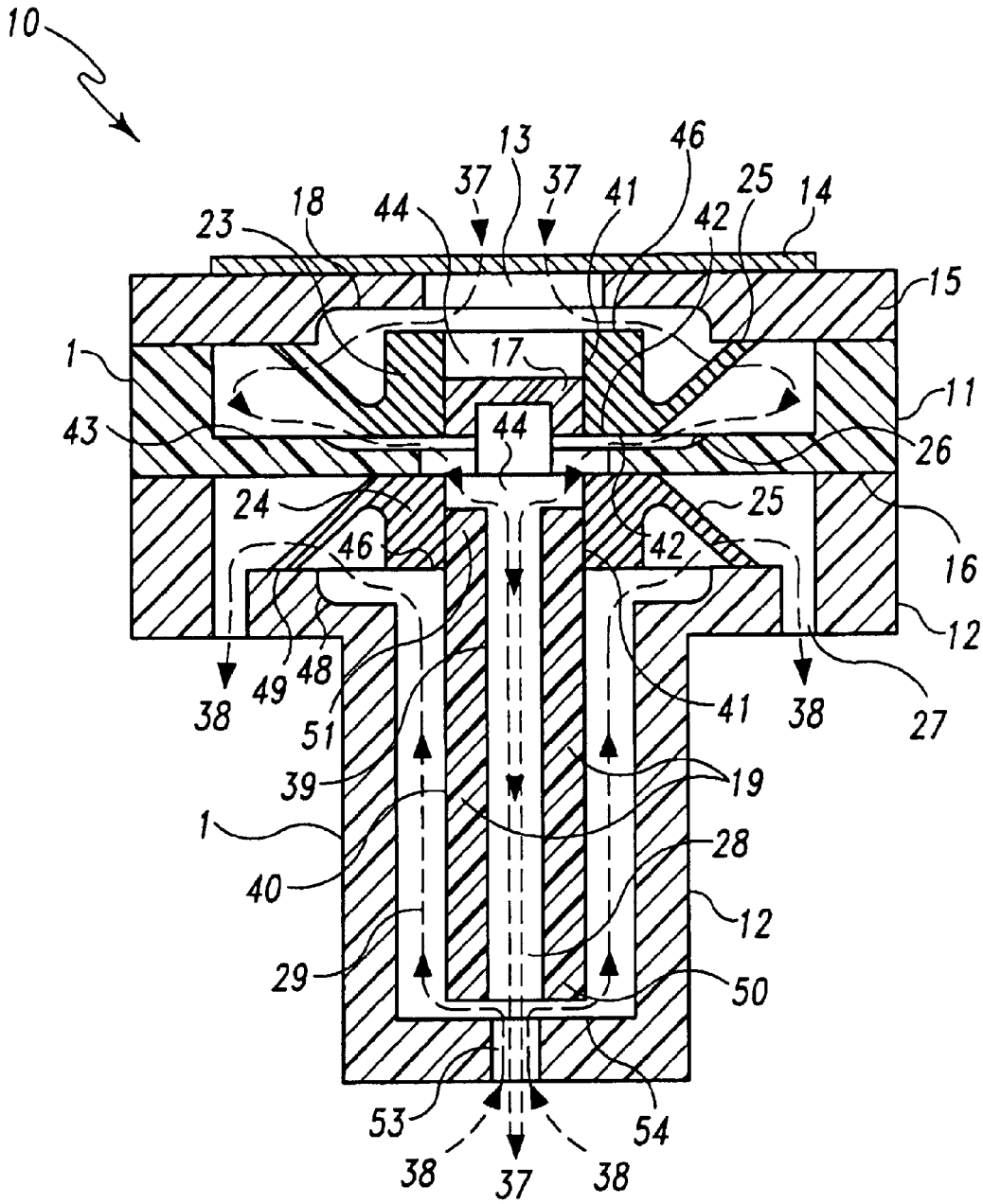
FIG. 7*b* is the same cross-sectional view of FIG. 7*a* that shows the path of incoming air and exiting air.
Figure 8A:
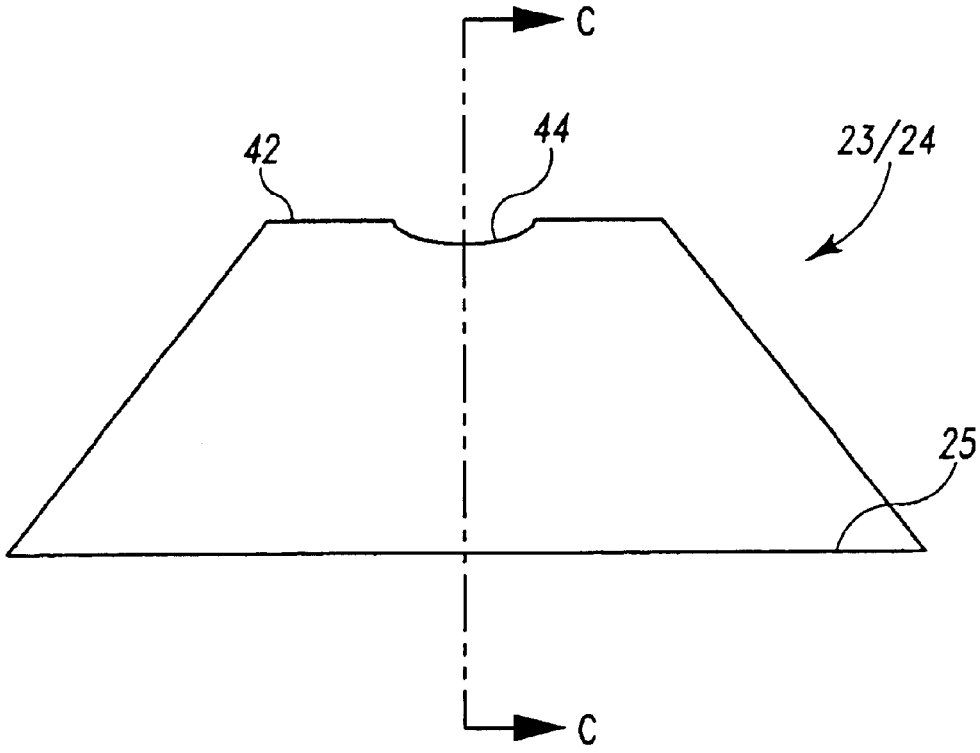
FIG. 8*a* is a side view of the valve structure of an intake valve and an exhaust valve utilized in the moisture control system of FIG. 3.
Figure 8B:
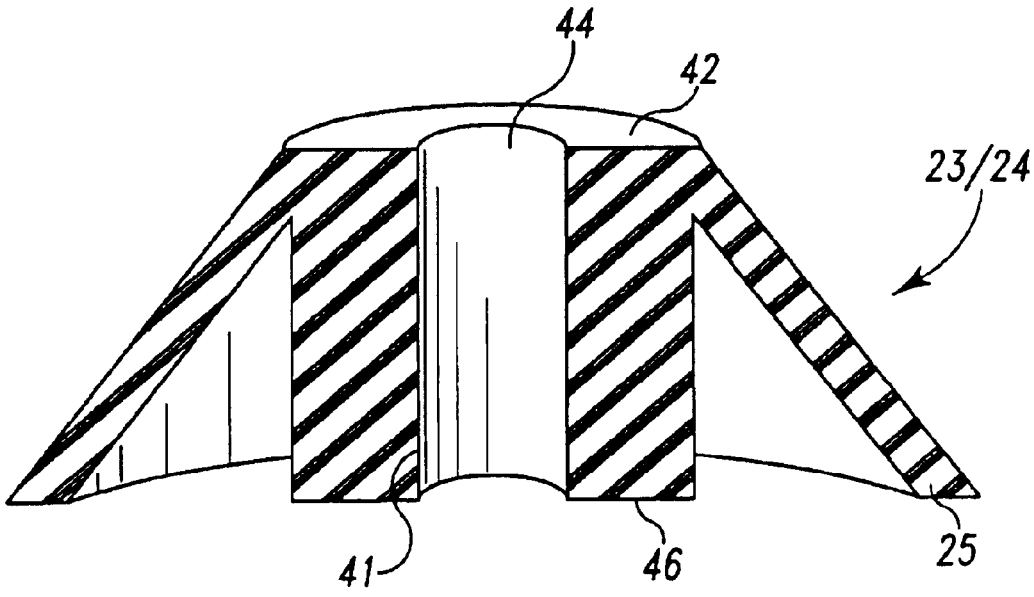
FIG. 8*b* is a cross-sectional view of the valve structure along line C—C of FIG. 8*a;*

FIG. 7*a* shows a cross-sectional view along line A—A of FIG. 6 of moisture control system 10 and FIG. 7*b* shows the same cross-sectional view with the paths of entering air 37 and exiting air 38 through moisture control system 10. As shown in FIG. 7*a*, intake valve 23 abuts the bottom side of lid 15 and rests on valve housing's 11 floor 43. As shown in FIG. 8*a*, the exemplary embodiment of intake valve 23 and exhaust valve 24 is a common umbrella valve of the same structure. FIG. 8*b* shows a cross-sectional view of the common valve structure along line C—C of FIG. 8*a*. As shown in FIG. 8*b*, the common valve structure of intake valve 23 and exhaust valve 24 comprises a seal edge 25, an inner edge 41, a top 42, a valve hole 44, and a bottom edge 46.

Referring back to FIG. 7*a*, intake valve 23 is placed in valve housing 11, so that its top 42 rests on floor 43 of the valve housing and its seal edge 25 forms a seal with the bottom side of lid 15. Intake valve's 23 seal edge 25 is located adjacent to intake channels 18 and is able to prevent any air from passing through moisture control system 10 into head lamp assembly 30 by forming a seal with lid 15. Inner edge 41 of intake valve 23 is placed over and around a hub 17, which is part of valve housing 11, so that the hub fits into valve hole 44. In this manner, intake valve 23 is held in place and centered in valve housing 11 by hub 17. While the exemplary embodiment of the subject invention uses an umbrella valve structure to control the influx of air into moisture control system 10, it will be appreciated by one skilled in the art that any number of valve structures could be used to construct the subject invention. Further, while the exemplary embodiment utilizes a hub to center the intake valve, one skilled in the art realizes that any number of means known in the art can be used to hold intake valve 23 in place.

Figure 9:
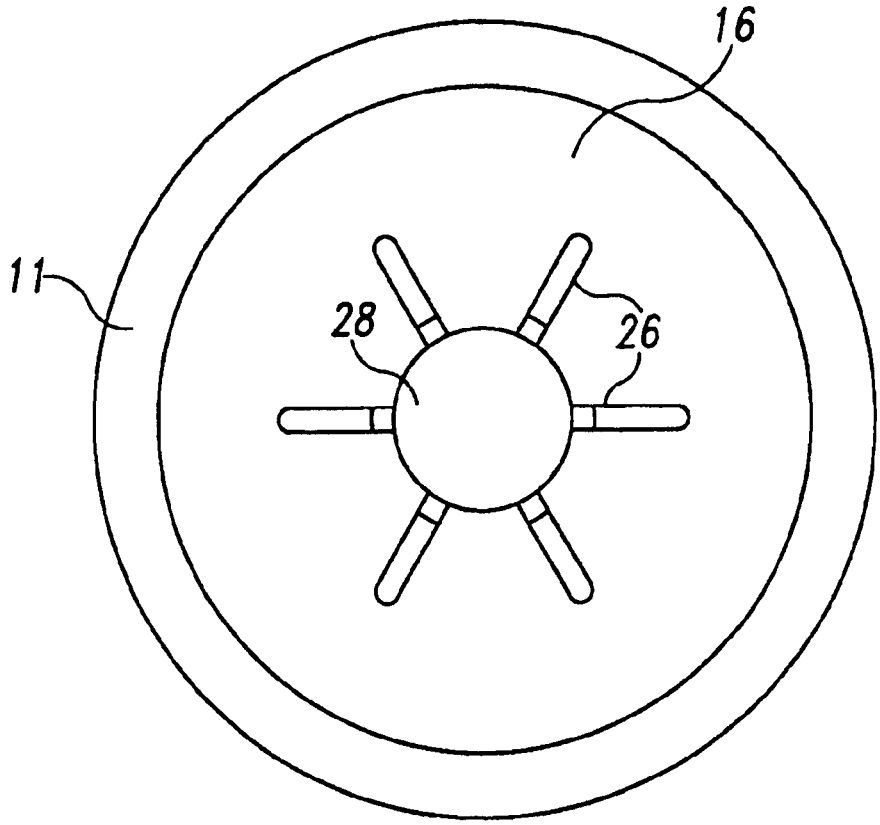
FIG. 9 is a top view of the valve housing of the moisture control system along line D—D of FIG. 6.

FIG. 9 shows a top view of valve housing 11 along line D—D of FIG. 6. As shown in FIG. 9, valve housing 11 contains a plurality of air intake slots 26 in its floor 16 that feed entering air into an intake passageway 28. While this embodiment of the valve housing contains six air intake slots, it will be appreciated by one skilled in the art that any number of air intake slots can be used to feed any entering air 37 into intake passageway 28.

Referring back to FIG. 7*a*, desiccant housing 12 is located just below floor 43 of valve housing 11. Desiccant housing 12 contains an exhaust valve 24. As already described and shown in FIGS. 8*a* and 8*b*, exhaust valve 24 has the same structure as intake valve 23. While this exemplary embodiment of the subject invention uses an umbrella valve structure to control the exhaust of air out of moisture control system 10, it will be appreciated by one skilled in the art that any number of valve structures could be used to construct the subject invention. Further, while this exemplary embodiment of the subject invention uses an exhaust valve 24 and intake valve 23 that share the same structures, it will be appreciated by one skilled in the art that the valves can also differ in valve structure.

Figure 10:
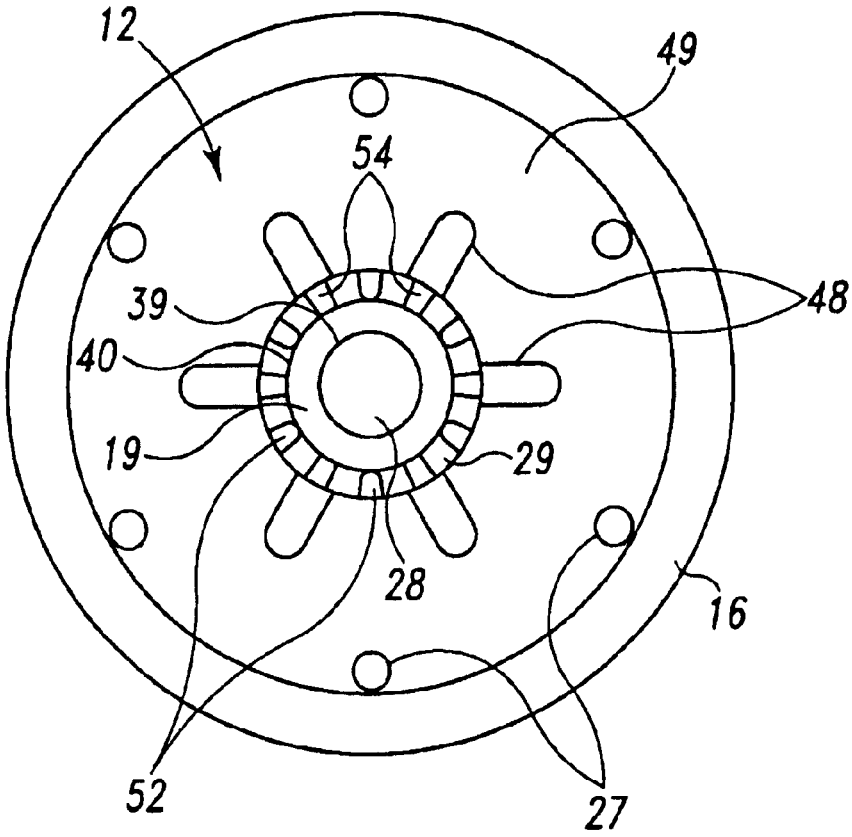
FIG. 10 shows a top view of the desiccant housing of the moisture control system along line E—E of FIG. 6.

FIG. 10 shows a top view of desiccant housing 12. As shown in FIG. 10, desiccant housing 12 contains a plurality of exhaust ports 27 and a plurality of exhaust slots 48. Air that passes through moisture control system 10 from headlamp assembly 30 is expelled through exhaust ports 27. Exhaust ports 27 are located in floor 49 of desiccant housing 12. While this exemplary embodiment of the subject invention utilizes six exhaust ports, it will be appreciated by one skilled in the art that any number of exhaust ports can be used to construct the subject invention. Further, it will be appreciated by one of ordinary skill in the art that exhaust ports are not limited to the displayed location, exhaust ports can be placed anywhere in the desiccant housing or valve housing so long as air passing through moisture control system 10 from the headlamp is allowed to be expelled after exhaust valve 24 opens.

As shown in FIG. 7*a*, exhaust slots 48 are located below exhaust valve 24 and allow air from headlamp assembly 30 to pass under the exhaust valve's bottom edge 46. In this manner, air passing through moisture control system 10 from headlamp assembly 30 will be directed toward seal edge 25 of exhaust valve 24. Referring back to FIG. 10, exhaust slots 48 are located in floor 49 of desiccant housing 12. While this exemplary embodiment of the subject invention utilizes six exhaust slots, it will be appreciated by one skilled in the art that any number of exhaust slots can be utilized to construct the subject invention. Referring back to FIG. 7*a*, exhaust valve 24 is placed in desiccant housing 12, so that top 42 of the exhaust valve rests against floor 43 of valve housing 11, inner edge 41 is placed over and around a cylindrical desiccant 19, seal edge 25 is located adjacent too a plurality of exhaust slots 48, and bottom 46 rests against floor 49 of the desiccant housing. Seal edge 25 forms a seal with floor 49 of desiccant housing 12 and is able to prevent any air from passing through control system 10 from headlamp assembly 30.

Figure 11:
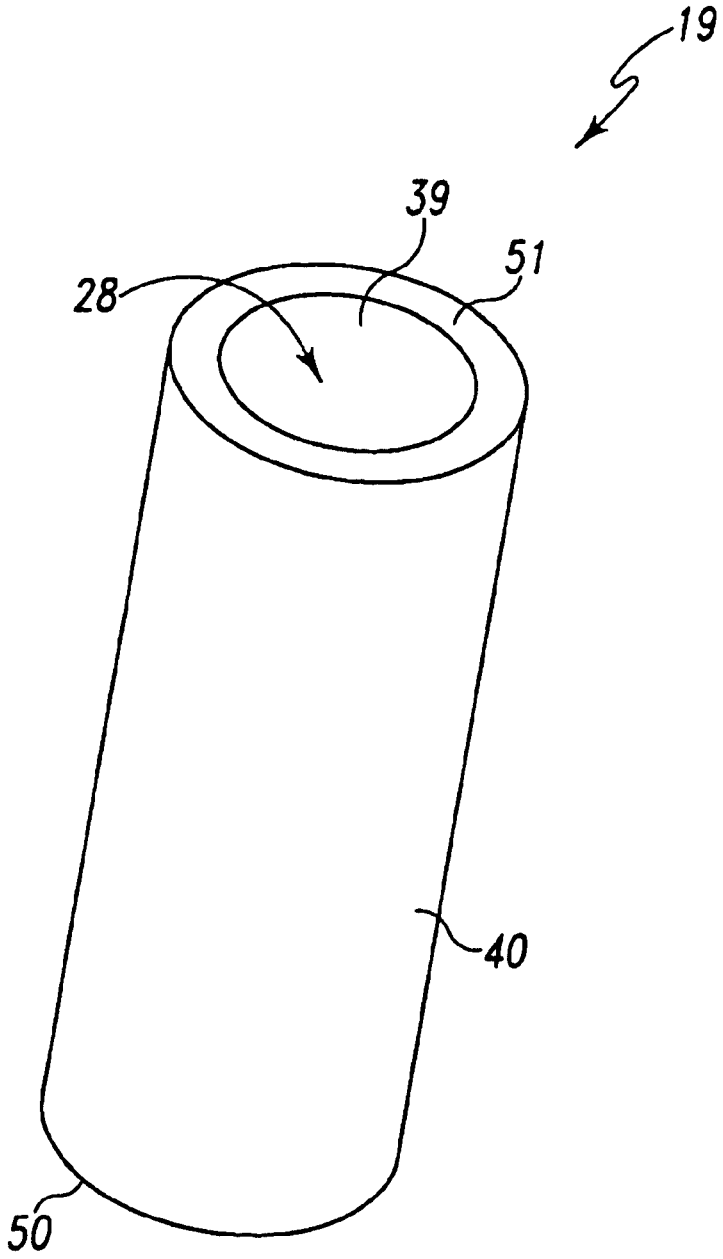
FIG. 11 is a side perspective view of a cylindrical desiccant utilized in the moisture control system of FIG. 3.

As shown in FIG. 7*a*, moisture control system 10 further comprises cylindrical desiccant 19. It will be appreciated by one skilled in the art that cylindrical desiccant 19 may be composed of any substance commonly known in the art that attracts moisture to its surface. FIG. 11 shows a side perspective view of cylindrical desiccant 19. Cylindrical desiccant 19 comprises an interior desiccant surface 39, an exterior desiccant surface 40, a bottom end 50, and a top end 51. While one end of cylindrical desiccant 19 is labeled as the top end and one end is labeled as the bottom end, it will be appreciated by one skilled in the art that there is no difference between the two ends and the cylindrical desiccant can be inserted into the subject invention with either end up or down. Interior desiccant surface 39 forms intake passageway 28 that runs the length of cylindrical desiccant 19. While cylindrical desiccant 19 is shown in FIG. 11 as one piece, it will be appreciated by one skilled in the art that the cylindrical desiccant can comprise a single cylindrical piece or several cylindrical pieces stacked upon one another to form intake passageway 28.

Referring back to FIG. 7*a*, cylindrical desiccant 19 is placed into desiccant housing 12 so that its top end 51 is placed inside hole 44 of exhaust valve 24 in order to allow incoming air to pass through the hole of the exhaust valve into intake passageway 28 of the cylindrical desiccant. Bottom end 50 sits above a ventilation hole 53 located in the bottom of desiccant housing 12 and a plurality of exhaust channels 54 located in the bottom of the desiccant housing. Referring back to FIG. 10, while moisture control system 10 is shown with six exhaust channels 54, it will be appreciated by one skilled in the art that any number of exhaust channels can be used to control the rate of air flow from headlamp assembly 30 through the moisture control system.

As shown in FIG. 10, cylindrical desiccant 19 is centered in desiccant housing 12 by a plurality of ribs 52 that run the length of desiccant housing 12. Cylindrical desiccant 19 is centered so that interior desiccant surface 39 is in line with ventilation hole 53 and so that exhaust channels 54 are located in between exterior desiccant surface 40 and desiccant housing 12. Ribs 52 contact exterior desiccant surface 40 and form a plurality of exhaust passageways 29 that allow air to escape out of headlamp assembly 30 by passing through exhaust channels 54 into the exhaust passageways. While moisture control system 10 is shown with six ribs 52, it will be appreciated by one skilled in the art that any number of ribs can be used to center the desiccant.

Due to the construction of cylindrical desiccant 19, exterior desiccant surface 40 has a surface area greater than that of inner surface 39 of the cylindrical desiccant. In this embodiment, exterior desiccant surface 40 has a surface area that is approximately twice the surface area of interior desiccant surface 39. While the exemplary embodiment has an exterior surface having approximately twice the surface area of the interior surface, one skilled in the art realizes that the difference in surface areas can be less than this differential or greater than this differential, as long as the exterior is of sufficient size to provide for adequate regeneration of the desiccant. Further, it will be appreciated by one skilled in the art that either or both interior desiccant surface 39 and exterior desiccant surface 40 may be grooved, ribbed or contain some other form of texture in order to maximize the available surface area. It will also be appreciated by one skilled in the art that cylindrical desiccant 19 does not have to be cylindrical in shape, but rather can be of any shape so long as exterior desiccant surface 40 has a surface area greater than the surface area of interior desiccant surface 39.

In operation, the temperature of the interior of headlamp assembly 30 increases during the periods of time in which it is utilized. After headlamp assembly 30 has been turned off, the headlamp assembly begins to cool. As the interior of headlamp assembly 30 cools, it creates a negative pressure condition inside the headlamp assembly relative to the exterior of the headlamp assembly. Referring to FIG. 7*b*, the higher external pressure causes seal edge 25 of exhaust valve 24 to remain sealed and causes seal edge 25 of intake valve 23 to open allowing entering air 37 to pass under the seal edge, through air intake slots 26, intake passageway 28, and out of ventilation hole 53 into the interior of headlamp assembly 30. Therefore, air from the atmosphere enters the interior of headlamp assembly 30 through moisture control system 10 to equalize the pressure between the interior and exterior of the headlamp. Entering air 37 is evenly distributed over interior desiccant surface 39 by intake slots 26 and moisture is removed from the entering air by cylindrical desiccant 19. Thus, moisture control system 10 removes moisture from entering air 37 before the entering air enters the interior of headlamp assembly 30, which in turn prevents the formation of condensation on the headlamp's interior surfaces.

During operation of headlamp assembly 30, light source 36 is energized and generates heat. The resulting heat builds up in the interior of headlamp assembly 30 and creates a positive pressure condition inside the headlamp assembly relative to the exterior of the headlamp assembly. Referring to FIG. 7*b*, the higher internal pressure causes seal edge 25 of intake valve 23 to remain sealed and causes seal edge 25 of exhaust valve 24 to open. The positive internal pressure forces the dry, heated exiting air 38 from the interior of headlamp assembly 30 through ventilation hole 53, exhaust channels 54, exhaust passageways 29, exhaust slots 48, under seal edge 25 of the exhaust valve, and out exhaust ports 27. Exhaust channels 54, exhaust slots 48 and exhaust passageways 29 ensure that the air flow is evenly distributed across exterior desiccant surface 40. Thus, dry, heated exiting air 38 from the interior of headlamp assembly 30 passes over exterior desiccant surface 40 and adequately regenerates cylindrical desiccant 19. In this manner, cylindrical desiccant 19 is able to continually absorb water from entering air 37.

Moreover, the combination of intake valve 23 and exhaust valve 24 in the headlamp moisture control system protects the desiccant from constant exposure to moisture from the atmosphere. Intake valve 23 remains closed and prevents air from entering into moisture control system 10 at all times except for when headlamp assembly 30 is in a cooling cycle. Further, exhaust valve 24 remains closed at all times except for when headlamp assembly 30 is operating. Thus, cylindrical desiccant is only exposed to air that contains moisture when headlamp assembly 30 is in a cooling cycle and the negative pressure causes intake valve 23 to open.

It will be appreciated by one skilled in the art that intake valve 23 and exhaust valve 24 can comprise any number of substances commonly known in the art to construct such valves and that a designer can choose the approximate pressure level that will cause intake valve 23 and exhaust valve 24 to open by increasing or decreasing the amount of stiffness. As used herein, the term "stiffness" means the substance's resistance to deforming. Thus, by choosing materials with the desired amount of stiffness to construct intake valve 23 and exhaust valve 24, a designer can make the intake valve open at a particular negative pressure and the exhaust valve open at a particular positive pressure.

Further, it will be appreciated by one skilled in the art that one can increase the temperature of exiting air 38 by choosing a substance or combination of substances to make up exhaust valve 24 that have a high amount of stiffness. The greater amount of stiffness exhaust valve 24 has, the longer it will stay closed during the build up of positive pressure and heat. Thus, substances with high stiffness will cause exhaust valve 24 to stay closed longer and allow the air inside headlamp assembly 30 to be heated longer by light source 36, which will lead to higher temperatures. The higher the temperature of exiting air 38 from headlamp assembly 30 across exterior desiccant surface 40, the faster cylindrical desiccant 19 is regenerated. In this manner, a designer of the subject invention can increase the temperature of exhausted air and increase the rate of regeneration.

Similarly, a designer can choose substances to construct intake valve 23 and exhaust valve 24 that increase in stiffness as temperatures decrease. In other words, there is an inverse relationship between the temperature of the exterior air and the stiffness of intake valve 23 and exhaust valve 24. It is the increasing stiffness of exhaust valve 24 in low temperature conditions (i.e., winter conditions) that will allow the cylindrical desiccant 19 to be adequately regenerated. When the exterior air is at a low temperature and enters headlamp assembly 30, it will have to be heated up to a sufficient temperature in order to allow cylindrical desiccant 19 to be regenerated. If the low end pressure release point of exhaust valve 24 is too low, seal edge 25 of the exhaust valve will open before exiting air 38 is heated to a point that will allow the desiccant to be regenerated. As used herein, the term "low end pressure release point" refers to the amount of pressure built up in the headlamp that will cause seal edge 25 of intake valve 23 and exhaust valve 24 to open. It will be appreciated by one skilled in the art that the increasing stiffness of exhaust valve 24 in low temperature conditions will increase the exhaust low end pressure release point of the exhaust valve. Thus, during low temperature exterior air conditions, the higher amount of stiffness of exhaust valve 24 will cause the exhaust valve to stay sealed for a longer period of time and will allow the air inside headlamp 30 to be heated to a sufficient temperature in order to regenerate cylindrical desiccant 19.

Figure 12A:
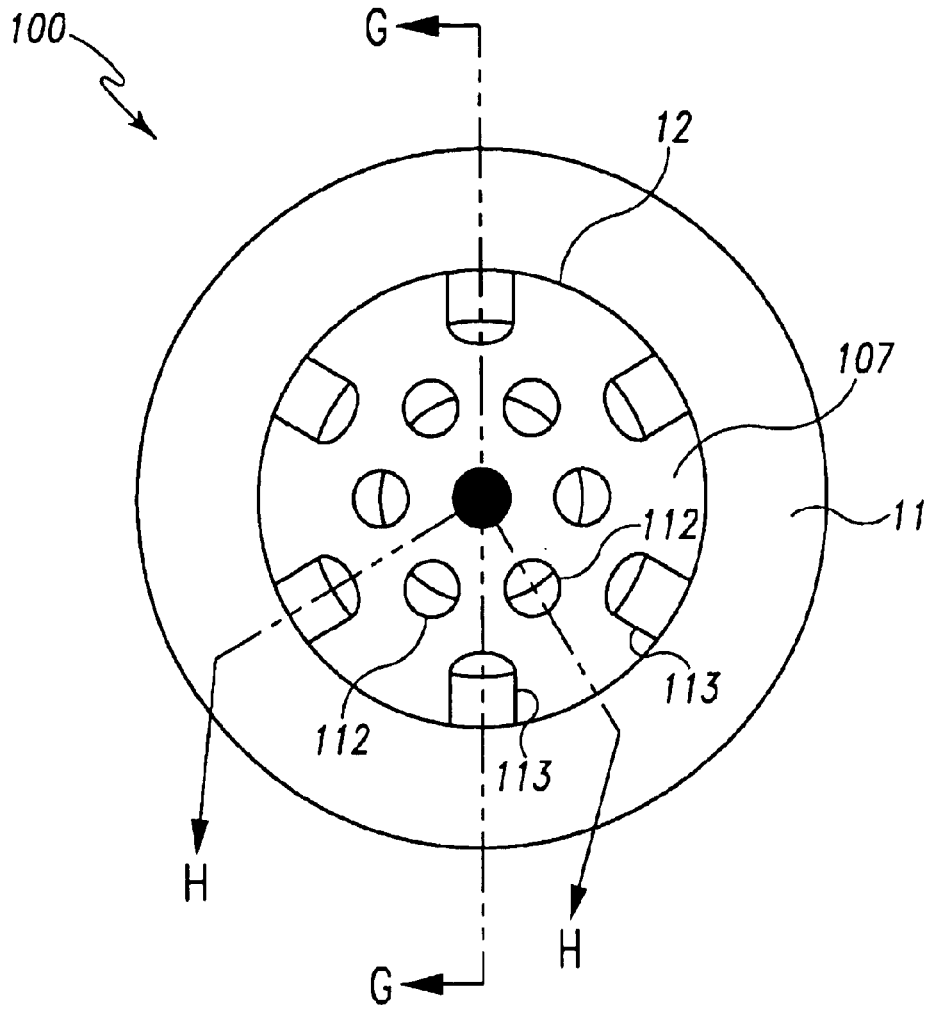
FIG. 12*a* is a bottom view of another embodiment of the moisture control system.
Figure 13A:
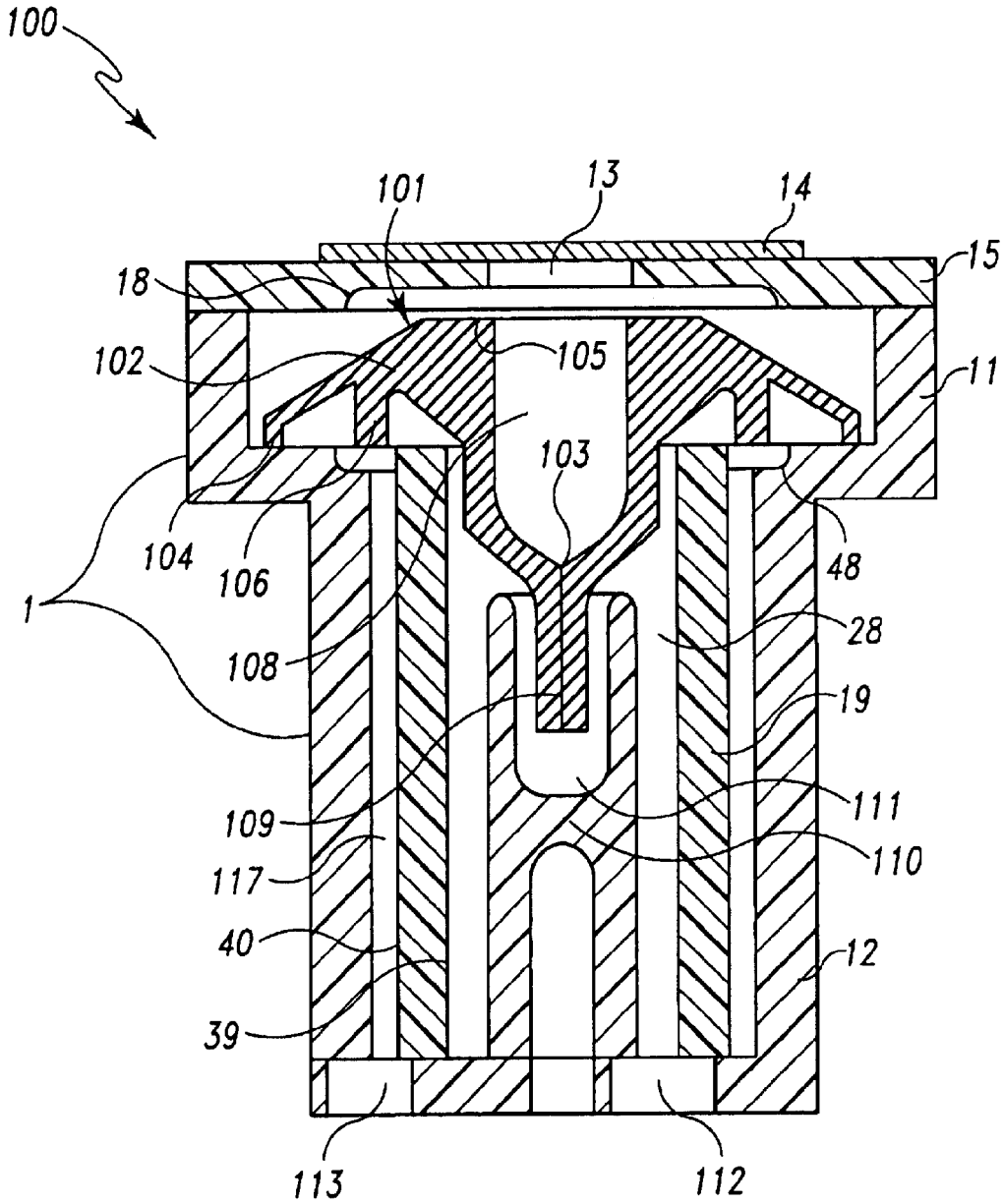
FIG. 13*a* is a cross-sectional side view of the moisture control system along section H—H of FIG. 12*a;*

Another embodiment of the subject invention reduces the overall size of the moisture control system and the number of parts needed to construct the moisture control system. FIG. 12*a* shows a bottom view of this other embodiment, moisture control system 100, and FIG. 13*a* shows a cross-sectional side view of moisture control system 100 along section H—H of FIG. 12*a*. As shown in FIG. 13*a*, moisture control system 100 comprises the same cylindrical desiccant 19 and lid 15 as described above. Lid 15 comprises air intake port 13, intake channels 18 located on the bottom of the lid, and filter 14 located over the air intake port. Further, as described above, moisture control system 100 also comprises housing 1 that generally comprises valve housing 11 and desiccant housing 12. However, in this embodiment, valve housing 11 and desiccant housing 12 are an integral piece. The interior of desiccant housing 12 also contains exhaust slots 48. Moreover, moisture control system 100 is attached to headlamp assembly 30 in the same way as the previously described moisture control system 10 (see FIGS. 4 and 5). While these are the similarities between the embodiments, moisture control system 100 also differs in various ways from the previously described exemplary embodiment.

As shown in FIG. 13*a*, moisture control system 100 comprises a combination valve 101. Combination valve 101 comprises an exhaust valve portion 102, an air recess 108 and an intake valve portion 103. Exhaust valve portion 102 comprises a seal edge 104, an inner edge 105, and a middle edge 106. Intake valve portion 103 comprises a duckbill valve structure 109.

Combination valve 101 is placed in moisture control system 100 so that seal edge 104 of exhaust valve portion 102 forms a seal with the floor of valve housing 11 and so that inner edge 105 forms a seal with lid 15. Further, combination valve 101 is placed in moisture control system 100 so that middle edge 106 forms a seal with the floor of valve housing 11 adjacent to exhaust channels 48 and so that duckbill valve structure 109 is placed within a hollow portion 111 of a cylindrical diffuser rib 110 located in the center of desiccant housing 12. Cylindrical diffuser rib 110 is located in the center of intake passageway 28. It will be appreciated by one skilled in the art that diffuser rib 110 does not need to be included in the subject invention but is included in this embodiment to help evenly distribute entering air 37 over interior desiccant surface 39. Further, it will be appreciated by one skilled in the art that combination valve 101 can take many different forms and still perform the same function as described herein.

Figure 12B:
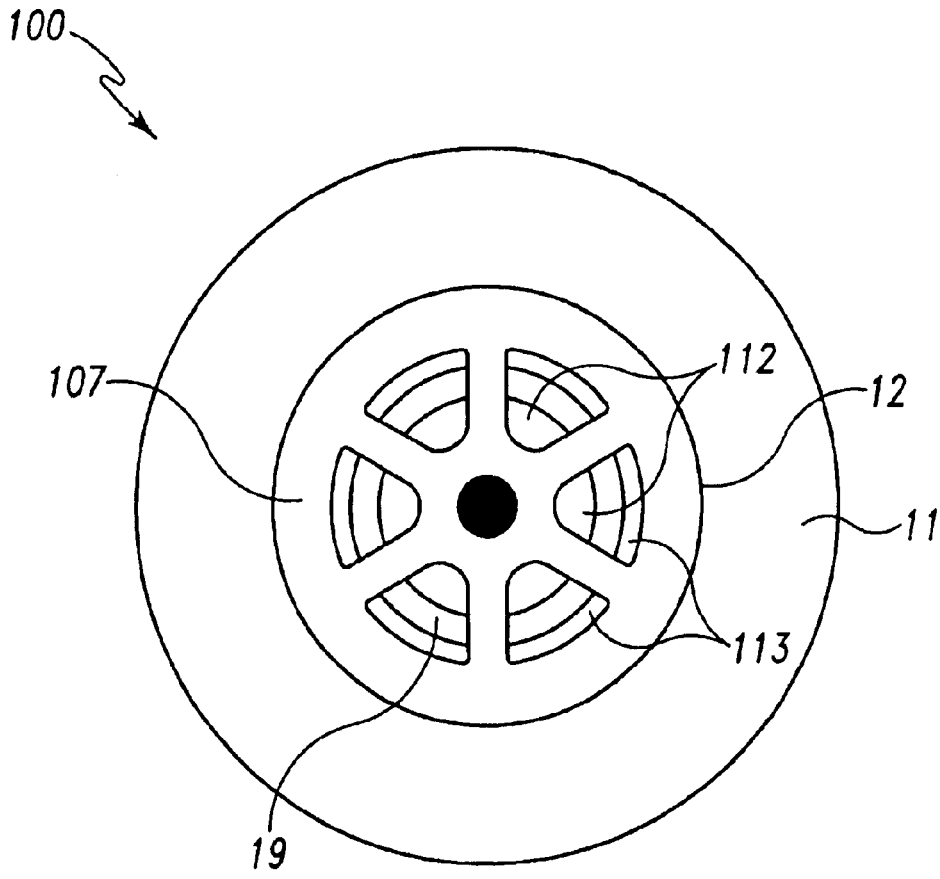
FIG. 12*b* is a bottom view of an alternative embodiment of the moisture control system embodiment of FIG. 12*a;*

Referring back to FIG. 12*a*, desiccant housing 12 comprises a bottom 107 which contains a plurality of intake exit holes 112 and a plurality of exhaust entrance holes 113. Referring back to FIG. 13*a*, intake exit holes 112 are located below intake passageway 28 so that air can pass from the intake passageway through the intake exit holes into headlamp assembly 30. While FIG. 12*a* shows moisture control system 100 with six intake exit holes 112, it will be appreciated by one skilled in the art that any number of intake exit holes can be created in bottom 107 of desiccant housing 12. Referring back to FIG. 13*a*, exhaust entrance holes 113 are located below exhaust passageway 117 so that air can pass from the interior of headlamp assembly 30 through the exhaust entrance holes 113 and into the exhaust passageway. While FIG. 12*a* shows moisture control system 100 with six exhaust entrance holes 113, it will be appreciated by one skilled in the art that any number of exhaust entrance holes 113 can be used. It will be further appreciated that intake exit holes 112 and exhaust entrance holes 113 are only limited in size by the material used to create desiccant housing 12 and the method used to create the holes. For example, FIG. 12*b* shows a bottom view of an alternative embodiment of moisture control system 100 where intake exit holes 112 and exhaust holes 113 are larger in size and are each separated by cylindrical desiccant 19.

Referring to FIG. 13*a*, cylindrical desiccant 19 is centered in desiccant housing 12 by a plurality of alignment features (not pictured in FIG. 13*a*) so that intake exit holes 112 will be aligned with intake passageway 28 and exhaust entrance holes 113 will be aligned with exhaust passageway 117. The alignment features can comprise any of a number of features well known in the art. Suitable alignment features include, but are not limited to, ribs that run the entire length of desiccant housing 12 or angled ribs located on the floor of desiccant housing 12.

The rate of flow of air into and out of headlamp assembly 30 depends on the size of and number of intake exit holes 112 and exhaust slots 48 respectively. It will be realized by one skilled in the art that alternatively exhaust entrance holes 113 can act to control the flow rate out of the headlamp assembly 30. Further, it will be realized by one skilled in the art that various embodiments of the subject invention can further reduce the size of the intake exit holes, the exhaust entrance holes, and exhaust slots by covering each of them with a screen or a membrane with the desired pore size.

Figure 13B:
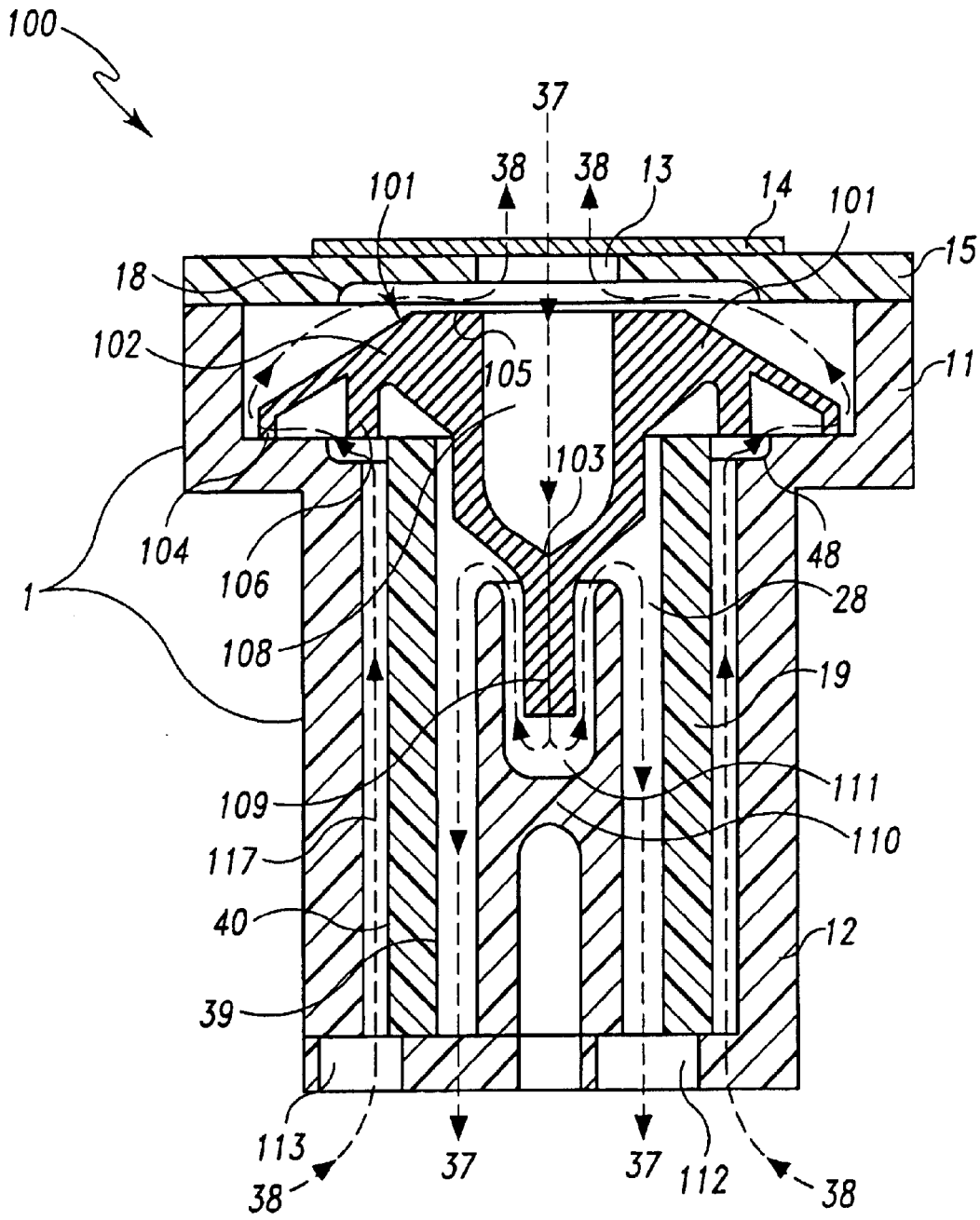
FIG. 13*b* is the same cross-sectional side view of FIG. 13*a* that shows the path of entering and exiting air through the moisture control system.

FIG. 13*b* shows a cross-sectional view of the moisture control system 100 along section H—H of FIG. 12 and the path of entering and exiting air through the moisture control system. During the cooling cycle of headlamp assembly 30, the negative pressure condition causes sealed edge 104 of exhaust valve portion 102 to remain sealed and causes duckbill valve structure 109 of combination valve 101 to open. As shown in FIG. 13*b*, this will allow entering air 37 to pass through air intake port 13, air recess 108, and duckbill valve structure 109. Entering air 37 will exit from duckbill valve structure 109 into hollow portion 111 of diffuser rib 110 which will evenly distribute the air over interior desiccant surface 39. The air will pass through intake passageway 28 and pass out of intake exit holes 112 into headlamp assembly 30.

During operation of headlamp assembly 30, light source 36 is energized and generates heat. The resulting heat builds up in the interior of headlamp assembly 30 and creates a positive pressure condition. As shown in FIG. 13*b*, the higher internal pressure causes duckbill valve structure 109 to remain sealed and exhaust valve portion 102 of combination valve 101 to open along seal edge 104. The positive internal pressure and open exhaust valve portion 102 forces dry, heated exiting air 38 from the interior of headlamp assembly 30 through exhaust entrance holes 113, exhaust passageway 117, exhaust slots 48, under seal edge 104 of the exhaust valve portion, and out air intake port 13. Exhaust entrance holes 113, exhaust slots 48 and exhaust passageway 117 ensure that exiting air 38 is evenly distributed across exterior desiccant surface 40.

Moisture control system 100 allows for the intake of air and the exhaust of air through the same opening, air intake port 13. This is advantageous because the air intake port 13 is protected from water and particulate matter intrusion by filter 14. Thus, no matter what orientation moisture control system 100 is inserted into headlamp assembly 30, the moisture control system will be protected from water and particulate matter intrusion. While moisture control system 100 allows for the intake of air and the exhaust of air through air intake port 13, it will be appreciated by one skilled in the art that an exhaust port or a plurality of exhaust ports can be utilized on lid 15, so that air exhausts out of the exhaust port(s) instead of air intake port 13. In this arrangement, the exhaust port(s) still could be covered by filter 14 and moisture control system 100 could still be utilized in any orientation with headlamp assembly 30. Further, it will be appreciated by one skilled in the art that other devices or membranes, such as a molded porous insert, can be used to similarly prevent water and particulate matter from entering the moisture control system.

Figure 14:
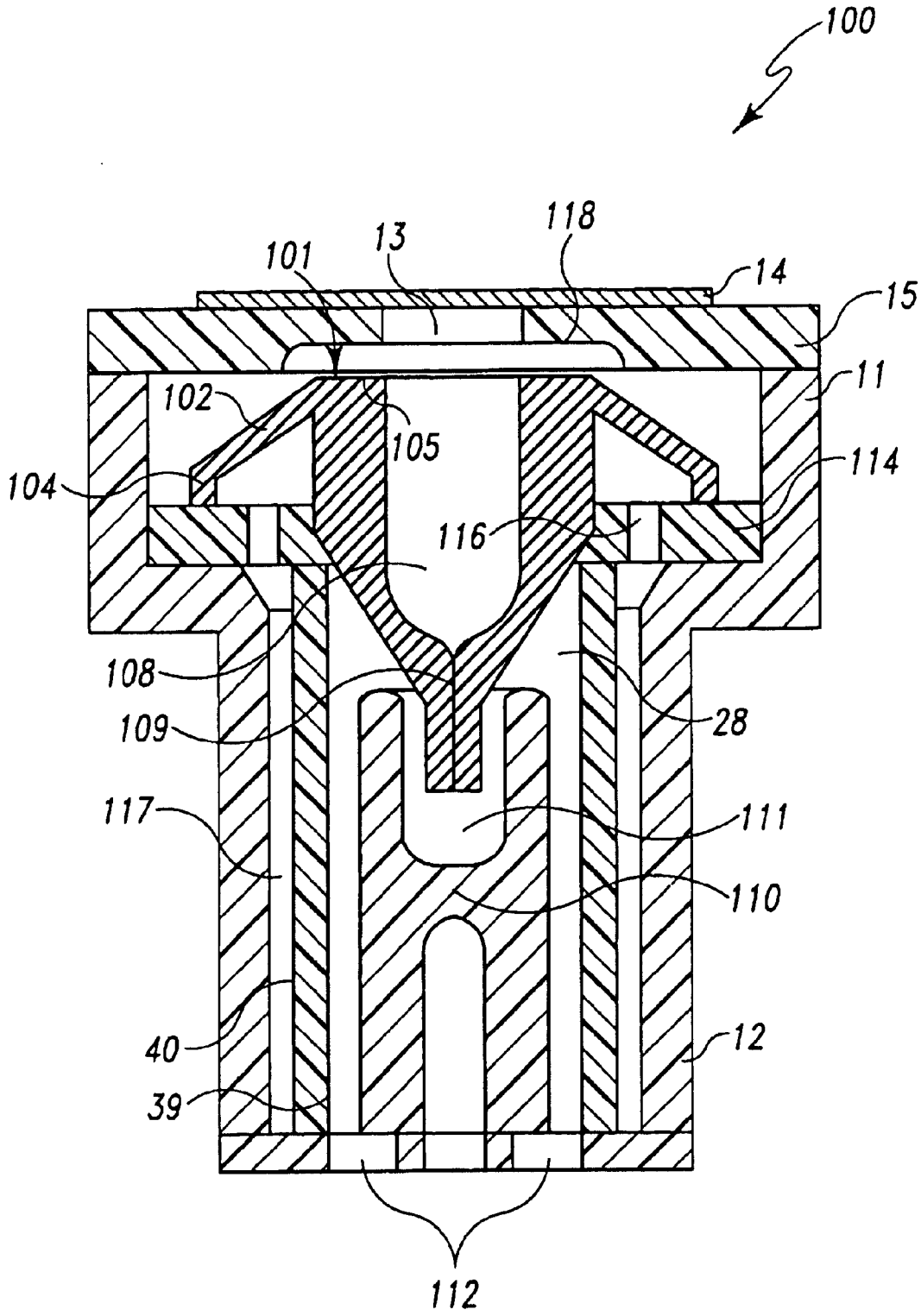
FIG. 14 is a cross-sectional, side perspective view of the moisture control system along line G—G of FIG. 12*a* further comprising a seal plate.

Optionally, moisture control system 100 can include a seal plate 114. FIG. 14 shows a cross-sectional, side view of moisture control system 100, along line G—G of FIG. 12, further comprising a seal plate 114. In this embodiment, combination valve 101 has the same structure except that exhaust valve portion 102 does not have a middle edge 106. Seal plate 114 is located directly below umbrella valve portion 102 so that seal edge 104 of the exhaust valve portion forms a seal with the seal plate. Seal plate 114 provides a smooth surface interface for exhaust valve portion 102 to form a seal. Thus, when materials are used to form moisture control system 100 that do not allow for a smooth surface on the floor of valve housing 11, seal plate 114 can be added to the moisture control system to provide a smooth surface interface for sealing purposes.

Figure 15:
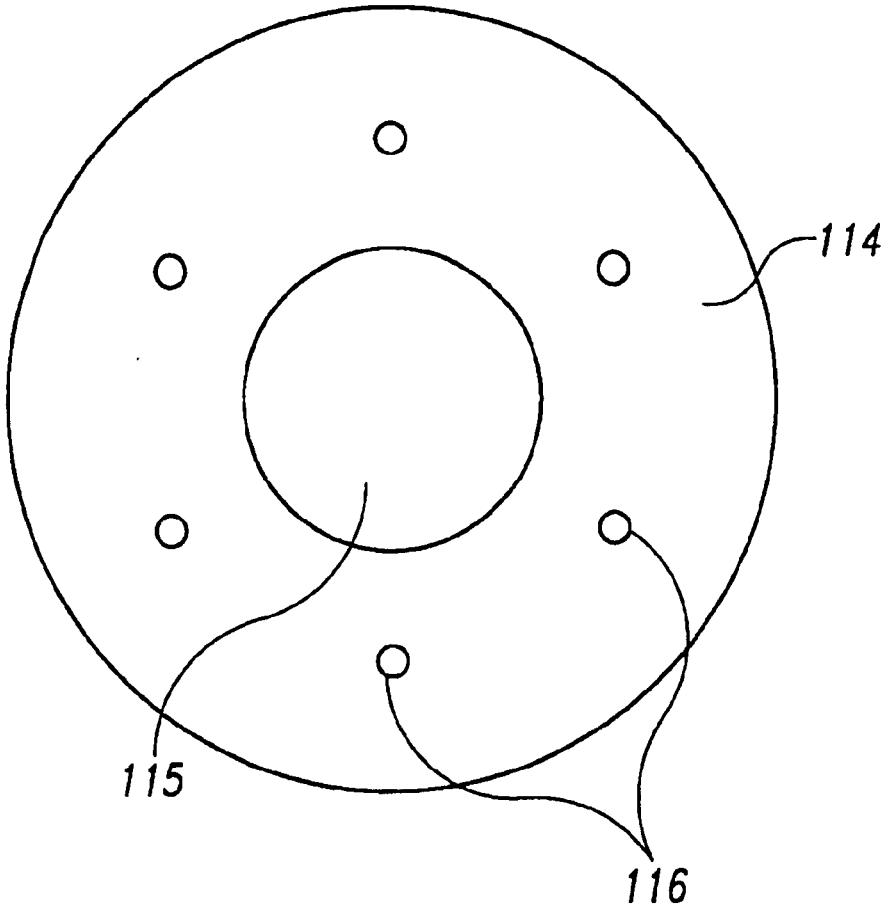
FIG. 15 is a top view of the seal plate utilized in the moisture control system embodiment of FIG. 14.

FIG. 15 shows a top view of seal plate 114. Seal plate 114 has a center hole 115 and a plurality of air holes 116. When seal plate 114 is added to moisture control system 100, the seal plate will rest on the floor of valve housing 11 with air holes 116 placed over exhaust passageway 117. While FIG. 15 shows seal plate 114 with six air holes 116, it will be appreciated by one skilled in the art that any number of air holes can be used to construct seal plate 114. Further, when combination valve 101 is placed into moisture control system 100, duckbill intake valve 109 will pass through center hole 115 into hollow portion 111 of diffuser rib 110. Thus, during the cooling process of headlamp assembly 30, air will still pass through moisture control system 100 in the same manner as already described. During operation of headlamp assembly 30, air will pass from the interior of headlamp assembly 30 through exhaust entrance holes 113 (not pictured in FIG. 14), exhaust passageway 117, air holes 116, underneath outer edge 104 of exhaust valve portion 102, and out air intake port 13.

While the subject invention has been described in considerable detail with reference to particular embodiments thereof, such is offered by way of non-limiting examples of the invention as many other versions are possible. It is anticipated that a variety of other modifications and changes will be apparent to those having ordinary skill in the art and that such modifications and changes are intended to be encompassed within the spirit and scope of the appended claims.

We claim:

1. An automotive lamp assembly moisture control system comprising:

a. a lamp housing having an air passage between an interior of the lamp housing and an exterior of the lamp housing;

b. at least one desiccant positioned in association with the air passage, the desiccant having an interior desiccant surface forming an intake passageway and an exterior desiccant surface defining at least one exhaust passageway, wherein the exterior desiccant surface area is greater than the interior desiccant surface area; and c. at least one valve arranged and disposed in association with the air passage to alternatively open and close the air passage.

2. The automotive lamp assembly moisture control system of claim 1 further comprising a lid connected to a valve housing that contains the at least one valve.

3. The automotive lamp assembly moisture control system of claim 2 wherein the lid contains at least one air intake port and a filter that prevents particulate matter and water from entering the at least one air intake port.

4. The automotive lamp assembly moisture control system of claim 3 wherein the lid further contains at least one intake channel adjacent to the at least one air intake port.

5. The automotive lamp assembly moisture control system of claim 1 wherein at least one ventilation hole is aligned with the intake passageway and at least one exhaust channel is aligned with the at least one exhaust passageway.

6. The automotive lamp assembly moisture control system of claim 1 wherein at least one intake exit hole is aligned with the intake passageway and at least one exhaust entrance hole is aligned with the at least one exhaust passageway.

7. The automotive lamp assembly moisture control system of claim 1 wherein the at least one valve comprises:

a. an intake valve that only allows air to pass through the headlamp moisture control system during negative pressure conditions; and b. an exhaust valve that only allows air to be exhausted from the headlamp moisture control system during positive pressure conditions.

8. The automotive lamp assembly moisture control system of claim 1 wherein the at least one exhaust passageway comprises a plurality of exhaust passageways formed by at least one rib that runs the length of and contacts the exterior desiccant surface in order to center the at least one desiccant so that the intake passageway formed by the interior desiccant surface is in line with at least one ventilation hole.

9. The automotive lamp assembly moisture control system of claim 1 wherein the at least one valve comprises a combination valve.

10. The automotive lamp assembly moisture control system of claim 9 further comprising a diffuser rib located in the intake passageway.

11. The automotive lamp assembly moisture control system of claim 1 wherein the exterior desiccant surface area is twice the size of the interior desiccant surface area.

12. An automotive lamp assembly moisture control system for use in a lamp assembly having an exterior and an interior comprising:

a. a housing;

b. at least one desiccant positioned within the housing with an interior desiccant surface forming an intake passageway and an exterior desiccant surface forming at least one exhaust passageway with the housing, wherein the exterior desiccant surface area is greater than the interior desiccant surface area; and c. an intake valve arranged and disposed within the housing to only allow air to pass through the intake valve during negative pressure conditions, and an exhaust valve arranged and disposed within the housing to only allow air to be exhausted through the automotive lamp assembly moisture control system during positive pressure conditions.

13. The automotive lamp assembly control system of claim 12 wherein the housing comprises:

a. a valve housing that contains the intake valve and at least one air intake slot located below the intake valve; and b. a desiccant housing that houses the exhaust valve and the at least one desiccant.

14. The automotive lamp assembly moisture control system of claim 12 further comprising a lid connected to the housing.

15. The automotive lamp assembly moisture control system of claim 14 wherein the lid contains at least one air intake port and a filter that prevents particulate matter and water from entering the at least one air intake port.

16. The automotive lamp assembly moisture control system of claim 15 wherein the lid further contains at least one intake channel adjacent to the at least one air intake port.

17. The automotive lamp assembly moisture control system of claim 12 wherein the exterior desiccant surface area is twice the size of the interior desiccant surface area.

18. The automotive lamp assembly moisture control system of claim 12 wherein at least one ventilation hole is aligned with the intake passageway and at least one exhaust channel is aligned with the at least one exhaust passageway.

19. An automotive lamp assembly moisture control system for use in a lamp assembly having an exterior and an interior comprising:

a. a housing b. at least one desiccant positioned within the housing with an interior desiccant surface forming an intake passageway and an exterior desiccant surface forming at least one exhaust passageway with the housing, wherein the exterior desiccant surface is greater than the interior desiccant surface; and c. a combination valve positioned within the housing.

20. The automotive lamp assembly moisture control system of claim 19 wherein the combination valve comprises:

a. an intake valve portion that only allows air to pass through the headlamp moisture control system during negative pressure conditions; and b. an exhaust valve portion that only allows air to be exhausted from the headlamp moisture control system during positive pressure conditions.

21. The automotive lamp assembly moisture control system of claim 19 further comprising a lid connected to the housing.

22. The automotive lamp assembly moisture control system of claim 21 wherein the lid contains at least one air intake port and a filter that prevents particulate matter and water from entering the at least one air intake port.

23. The automotive lamp assembly moisture control system of claim 22 wherein the lid further contains at least one intake channel adjacent to the at least one air intake port.

24. The automotive lamp assembly moisture control system of claim 19 wherein the housing further contains a cylindrical diffuser rib with a hollow portion, the cylindrical diffuser rib being located in the intake passageway.

25. The automotive lamp assembly moisture control system of claim 20 wherein the housing further contains a seal plate located below the exhaust valve portion of the combination valve so that the exhaust valve portion can form a seal with the seal plate.

26. The automotive lamp assembly moisture control system of claim 19 wherein at least one intake exit hole is aligned with the at least one intake passageway and at least one exhaust entrance hole is aligned with the at least one exhaust passageway.

27. The automotive lamp assembly moisture control system of claim 19 wherein the exterior desiccant surface area is twice the size of the interior desiccant surface area.

28. A method of venting a lamp assembly while continually preventing moisture from entering into the lamp assembly comprising the steps of:

a. providing in a lamp assembly a moisture control system comprising at least one desiccant with an interior desiccant surface forming an intake passageway and an exterior desiccant surface forming at least one exhaust passageway, wherein the exterior desiccant surface is greater than the interior desiccant surface;

b. removing moisture from incoming air by causing the incoming air to pass into the lamp assembly through the moisture control system over the interior desiccant surface; and c. regenerating the desiccant by causing heated air to exhaust out of the lamp assembly through the moisture control system over the exterior desiccant surface.

29. The method of venting a lamp assembly while continually preventing moisture from entering into the lamp assembly of claim 28 further comprising the step of increasing the temperature of the heated air by keeping the heated air in the lamp assembly until a certain low end pressure release point is reached.

* * * * *